United States Patent [19]

Krus

[11] Patent Number: 4,595,619

[45] Date of Patent: Jun. 17, 1986

[54] METHOD OF AND DEVICE FOR PRODUCING BUNDLES FROM STRIP AND BUNDLE PRODUCED THEREBY

[75] Inventor: Werner Krus, Leverkusen, Fed. Rep. of Germany

[73] Assignee: Rockwell International, Downers Grove, Ill.

[21] Appl. No.: 620,349

[22] Filed: Jun. 13, 1984

[51] Int. Cl.[4] ..... B65H 35/02

[52] U.S. Cl. ..... 428/114; 156/259; 242/56.2; 428/906

[58] Field of Search ..... 29/412; 60/915; 156/255, 259, 344; 428/55, 56, 155–157, 107, 109–114, 294, 464, 906; 242/56.2, 56.3, 56.7, 59, 77.1

[56] References Cited

U.S. PATENT DOCUMENTS

| | | | |
|---|---|---|---|
| 2,425,123 | 8/1947 | Quayle et al. | 242/56.2 |
| 3,772,112 | 11/1973 | Lyons et al. | 156/259 |
| 3,773,585 | 11/1973 | Butcher | 156/259 |
| 3,779,475 | 12/1973 | Plevin | 242/56.2 |
| 4,110,505 | 8/1978 | Prewo | 428/114 |
| 4,528,798 | 7/1985 | Meier | 242/59 |

OTHER PUBLICATIONS

"Wickein im Verbund", *Continentaler Stahlmarkt*, 12/83, pp. 59–60, (With English Translation).

"Neue Verbundwicklung für Bander-Verwicklungen Ausgeschlossen", *Blech.Rohre.Profile*, 31 (1984) 3, pp. 94–95, (With English Translation).

"Schliesst Verwicklungen bei Spaltbandern aus", *Techno-Tip*, Mar. 3, 1984.

"Rationalisierung", *Hoppenstedt Handling Journal*, Handling-Nr. 52, Mar./Apr. 1984.

"Gegen Unerwunschte Verwicklungen", *Scope*, Scope Nr. 15, Apr. 1984.

*Primary Examiner*—William J. Van Balen

*Attorney, Agent, or Firm*—C. B. Patti; V. L. Sewell; H. Fredrick Hamann

[57] ABSTRACT

To produce bundles from strip, the strip is withdrawn from an uncoiler or coil and slit into a number of narrow strips that are supplied parallel and separated by about 2 mm to a winding point. The strip is wound at the winding point into bundles with a sheet-like or film-like insert that extends over the total width of the strips being supplied adjacent to each other also being wound in between the individual layers of the bundles. When the resultingly wound strip are unwound, the insert between the bundle at one end of the composite coil and the rest of the composite coil is separated in such a way that a strip of insert is removed along with a strip of metal from the composite coil and wound or coiled separately from the metal strip. The composite coil made up of individual parallel metal strips with the insert wound between them can be conveniently handled for conveying and storage at both its surface and side edges.

13 Claims, 2 Drawing Figures

Figure 1:
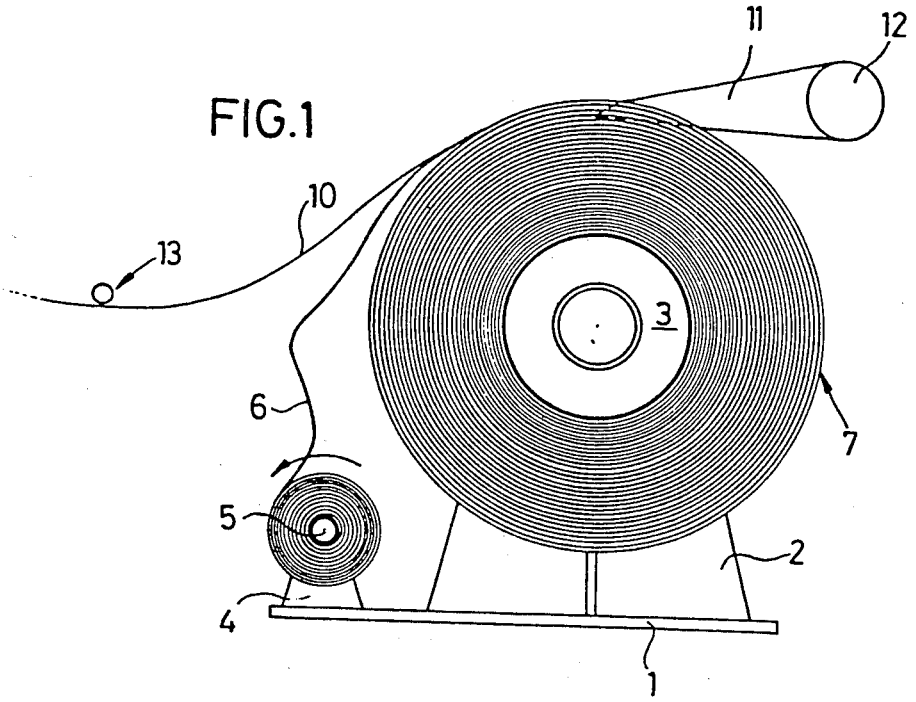

METHOD OF AND DEVICE FOR PRODUCING BUNDLES FROM STRIP AND BUNDLE PRODUCED THEREBY

The invention relates to a method of producing bundles from strip, in which a strip of preferably metal is withdrawn from an uncoiler and slit lengthwise into a number of narrow strips that are coiled together parallel to one another into bundles. The invention also relates to a device for carrying out the method and to a bundle produced by the method or on the device.

Bundles have previously been produced from strip by withdrawing a strip of metal from a reel or coil and then slitting it lengthwise into narrow strips that are coiled together parallel to one another on a powered arbor that a number of disks are mounted on to keep the individual strips separate so that they can be wound into separate bundles. The bundles must be removed individually from the arbor upon termination of the winding process, bunches together with a strip of sheet metal on a special device, and finally stacked for storage.

A wide range of problems has occurred in particular with very narrow strips, from 5 to 15 mm wide. Physical laws limit the bundle diameter of the bundles such that, specifically, a bundle must not be any heavier than 3 kg per mm of strip width. Winding with spacer disks on the arbor and the resulting necessity of securing the individual bundles is expensive because of the manual setup times involved. Breakdowns in handling because of scrap instrusions are frequently unavoidable, specifically because strip escapes especially from the center of the individual bundles before it has been fastened together. This escaping strip can generally be employed only as scrap and must be cut off. Injuries to personnel as well can not be completely eliminated while the bundles are being handled. There are also in-house problems with storage and conveying. Furthermore the strips can get cambered. Finally the cut edges of the finished strip can get damaged while it is being conveyed and stored.

Attempts have been made to overcome these problems by not slitting the strip of metal completely as it leaves the reel or coil but only partially, so that adjacent strips remain joined at various points. These joints are selected in such a way that they can easily be separated when the individual strips are unwound. Although this method does allow the production of bundles with long bundle diameters and diminishes the storage and conveyance problems, it has a disadvantage in that the cut edges of the strips are irregular because the points at which the strips and separated when unwound from the coil leave a certain amount of roughness. Strip of this type accordingly often does not satisfy customer demands.

The object of the present invention is to very economically produce bundles from strip and especially narrow strip, from 5 to 17 mm wide, that can be handled and unwound reliably and practically even after finishing and that contain strip of unobjectionable quality.

This object is attained in accordance with the invention in that completely separated strips are coiled with a sheet-like or film-like intermediate layer inserted between, and hence wound along with, the individual layers of strip, connecting the adjacent bundles together. In so doing, the individual strips are preferably wound with a space left between them into a composite coil along with the intermediate layer.

In accordance with the invention, therefore, a composite coil is produced that consists of a number of individual bundles that are connected by means of an insert of paper or plastic sheet that extends over the total width of the composite coil and are accordingly secured together. To prevent the individual bundles from being unintendedly unwound it is necessary only to attach the outermost end of each strip to the bundle, with a strip of adhesive tape for example. To unwind the individual bundle it is necessary only to release the outer end of the appropriate strip and unwind it. The remaining bundles of the composite coil remain wound without any special measures having to be taken to secure them. Nor do the edges of the individual bundles have to be specially protected because the wound-in intermediate layer can extend far enough beyond the sides of the composite coil to prevent the edges of the outermost bundles from getting damaged and because the intermediate layer keeps the bundles of the coil far enough apart to prevent damage from contact between adjacent strips.

The invention allows the production of composite coils that are heavier and can accordingly have a longer diameter. Weights of up to 10 kg per mm of width are possible. Thus, bundles weighing 1000 kg, for example, have been obtained in accordance with the invention. A composite coil can include 20 bundles for example, and that at an outside diameter of up to 1300 mm and inside diameters of 300, 400, or 500 mm. A composite coil can have a maximum width of up to 1500 mm or more, not depending ultimately on the length of the arbor available for winding.

The composite coil that can be produced in accordance with the invention can be removed from the arbor as a single unit and conveyed and stored in that form. The individual bundles can be coiled off by placing the whole composite coil on an uncoiler and rotating it in the unwinding direction even though all the strips do not need to be coiled off simultaneously. Although heavy weights have to be shifted in doing so, coiling off is more economical on the whole because the composite coil has to be placed on the coiler only once, subsequent to which it is unnecessary to remove several strips from the individual bundles before they can be coiled off. It is, rather, sufficient to unfasten the outer end of the particular bundle before unwinding.

The intermediate layer inserted during winding is preferably separated by layers between the adjacent bundles while the individual bundles are being unwound or uncoiled in such a way that the intermediate layer will extend beyond the ends of the rest of the composite coil just enough to ensure the desired edge protection. The separated strips of the intermediate layer are coiled up in a practical way during the unwinding process and can be discarded.

The object of the invention is also attained with a device that has a mechanism for introducing an insert in the form of a web or an intermediate layer between the individual layers or turns of the strip while it is being wound and a cutting mechanism for separating the insert layer by layer while the individual bundles are being unwound. When an uncoiler separate from that employed for producing the composite coil is employed to unwind the bundle, the cutting mechanism is mounted on the uncoiler employed for unwinding.

The cutting mechanism is preferably a knife that can be constantly adjusted radially and that acts in a stationary position on the insert or intermediate layer in the composite coil in the space between two adjacent strips. Such a cutting mechanism is especially simple and practical.

Finally, the object of the invention is attained with a bundle that is obtained from strip, that has several adjacent bundles made out of strip with a space between them, and that has a continuous insert in the form of a web of a separable material like paper or plastic sheet between each layer or turn to hold the separate bundles together and with a short piece extending beyond the sides of the bundle to protect the longitudinal edges of the strip against any kind of damage.

The adjacent strips are preferably about 2 mm apart. This is far enough to guarantee that the edges of the strip will be protected.

Since no strapping is necessary to hold the coil rings or bundles together, no depressions will be left on the edges of the strip by strapping connectors. The individual strips are extensively prevented from cambering because the paper or plastic-sheet insert between the individual turns prevents cutting burrs in the strip from adding up from turn to turn and even compensates from them. Since the invention allows the coil diameters to be as long as desired even when the strip is less than 10 mm wide, the bundles can weigh three times as much as previously and strip three times as long as previously can be wound into a bundle. No troublesome manual threading of individual strips or insertion of separating disks between the individual strips is necessary because operations can be carried out without separating disks or sheets and all parallel strips can be threaded into the uncoiler in a single operation no matter how many strips are to be wound simultaneously.

A composite coil produced in accordance with the invention, which, like a kind of magazine, contains many bundles, is highly superior to the conventional separately wound bundle strip coils with respect to conveyance because the individual strips in a composite coil are secured by the insert of paper or plastic sheet, constituting a more reliable conveyance unit. There are no problems in storing and stacking such a unit. The processor can raise 60 times as much material onto his uncoiler with a single lift. Manual setup times are extensively avoided because one composite coil can accommodate up to three times as much strip length and can contain up to 20 adjacent bundles.

The processor can interrupt separating, unrolling one of the bundles, that is, at any time, even in the middle of unwinding a bundle, so that the rest can be returned to storage with further packing labor.

Another advantage to the inserts in accordance with the invention is that they extensively protect the surface of the strip from mechanical destruction, which is especially significant when the material is sensitive.

Introducing the insert saves the now necessary expense of mechanically wrapping the individual bundles while they are being packaged. Handling one composite coil is also much less dangerous than handling several narrow bundles.

The strip which can be split and wound into separate bundles can be made wholly or partially of any flexible windable material including metal, plastics, rubber, textile fabric (including woven and nonwoven) as well as cellulose, including paper and paper products and the like. In general, the process and apparatus of the invention are applicable to all materials which heretofore have been wound.

Figure 2:
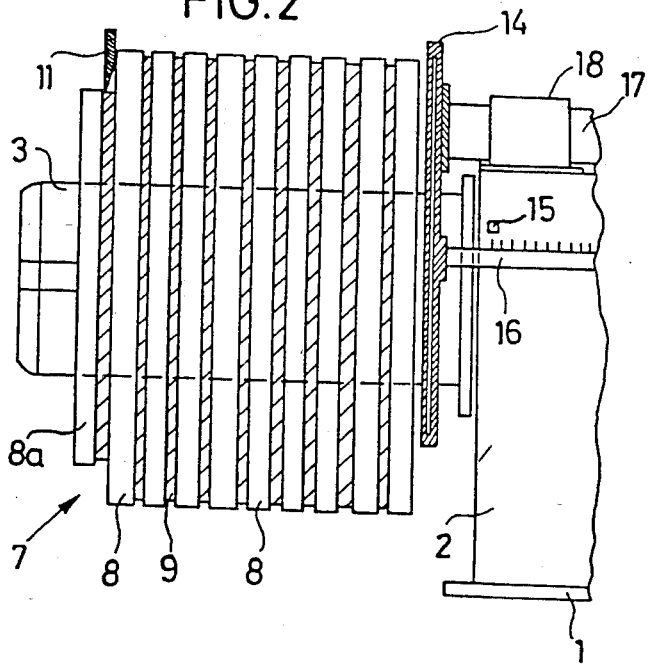

One embodiment of an uncoiling device that can be employed to unwind a composite coil in accordance with the invention, specifically bundle by bundle, will now be described in detail with reference to the drawing, in which FIG. 1 is a side view of the uncoiling device and FIG. 2 is a front view of the same device.

The uncoiling device has a housing 2 attached to a base plate 1. An arbor 3 rotates on housing 2. A coiling mechanism 4 with a rotating shaft 5 that can be employed to wind a strip 6 of paper or plastic sheet separated from the insert in the bundle is also mounted on base plate 1.

A composite coil 7 has been positioned on the arbor 3 of the uncoiler in such a way that it cannot rotate with respect to it. Composite coil 7 consists of a number of bundles 8 connected by an insert 9 made out of paper, plastic sheet, or a similar material. Insert 9 has been introduced between the individual turns of strip and extends over the total length of composite coil 7. Insert 9 preferably extends somewhat beyond the sides of composite coil 7 to protect the lateral edges of metal strip 10 at the sides of the coil from damage. The projecting sections of insert 9 are not illustrated in FIG. 2.

As will be evident from FIG. 2, a specific amount of space, which may measure 2 mm for example, is left between the adjacent bundles 8 held together by insert 9. This prevents adjacent strips from touching and damaging one another.

A ripping knife 11 that pivots around a shaft 12 is associated with arbor 3. When the frontmost bundle 8*a* is unwound, ripping knife 11 cuts the insert 9 between that bundle and the next bundle 8 in such a way that a strip 6 of insert 9 leaves the coil and can be wound on coiling mechanism 4. Ripping knife 11 pivots around shaft 12 so that it can follow the decreasing outside diameter of frontmost bundle 8 and can separate insert 9 until the metal strip 10 has completely left frontmost bundle 8*a*.

Metal strip 10 travels below a loop controller 13 as it leaves frontmost bundle 8*a* and arrives at a consuming device that is not illustrated.

To keep frontmost bundle 8*a* correctly positioned with respect to ripping knife 11, the uncoiling device has a synchronized position shifter 14 that, controlled by a generator 15 and pulse conductor 16, can be shifted toward the free end of arbor 3 in order to always move composite coil 7 forward into the correct operating position. A plunger 17 and guide 18 ensure straight-line motion on the part of the plate-shaped position shifter 14.

What is claimed is:

1. In a method of producing bundles from strip, in which strip is withdrawn from an uncoiler and slit lengthwise into a number of narrow strips that are coiled together parallel to one another to form bundles, the improvement wherein the strips are coiled by inserting a sheet-like or film-like intermediate layer between the individual layers of strip to connect the adjacent bundles together.

2. The method as in claim 1, wherein the individual strip are wound with a space left between adjacent strips along the intermediate layer to form a composite coil.

3. The method as in claim 1, further comprising separating the intermediate layer layer by layer between the adjacent bundles while the individual bundles are being unwound.

4. The method as in claim 1, wherein said strip is a metal strip.

5. The method as in claim 1, wherein said strip is a plastic strip.

6. The method as in claim 1, wherein said strip is a rubber strip.

7. The method as in claim 1, wherein said strip is a textile strip.

8. The method as in claim 1, wherein said strip is a cellulose strip.

9. In a device for producing bundles from strip having a mechanism for slitting a strip lengthwise into a plurality of narrow strips, the improvement comprising a mechanism for introducing an insert in the form of a web or an intermediate layer between the individual layers or turns of the strip while winding same and a cutting mechanism for separating the insert layer by layer while the individual bundles of narrow strips are being unwound.

10. The device as in claim 9, wherein the cutting mechanism is a knife that can be constantly adjusted radially.

11. The device as in claim 9, further comprising a mechanism for winding the strips of web that emerge while the individual bundles are being unwound.

12. A composite coil comprising several adjacent bundles made out of strip with a space between them and a continuous insert in the form of a web of a separable material like paper or plastic sheet between each layer.

13. The composite coil as in claim 12, wherein the insert extends beyond the sides of the composite coil.

* * * * *

UNITED STATES PATENT AND TRADEMARK OFFICE

CERTIFICATE OF CORRECTION

PATENT NO. : 4,595,619
DATED : June 17, 1986
INVENTOR(S) : Werner Krus

It is certified that error appears in the above-identified patent and that said Letters Patent is hereby corrected as shown below:

| | |
|---|---|
| Title Page, "Attorney, Agent, or Firm" | Delete "C.B. Patti; V. L. Sewell; H. Fredrick Hamann" and substitute --Sprung Horn Kramer & Woods-- |
| Col. 1, line 52 | Delete "and" and substitute --are-- |

Signed and Sealed this

Twenty-fourth Day of March, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,595,619

DATED : June 17, 1986

INVENTOR(S) : Werner Krus

It is certified that error appears in the above-identified patent and that said Letters Patent is hereby corrected as shown below:

| | |
|---|---|
| Title Page, Assignee No. [73] | Delete "Rockwell International, Downers Grove, Ill." and substitute --Karl Jüngel GmbH & Co. KG, Leverkusen, Germany-- |

Signed and Sealed this

Twenty-first Day of November, 1989

*Attest:*

JEFFREY M. SAMUELS

*Attesting Officer*

*Acting Commissioner of Patents and Trademarks*